United States Patent [19]

Stoddard et al.

[11] 4,246,966

[45] Jan. 27, 1981

[54] PRODUCTION AND WET OXIDATION OF HEAVY CRUDE OIL FOR GENERATION OF POWER

[76] Inventors: Xerxes T. Stoddard, 4617 W. 27th Ave., Denver, Colo. 80212; Vesper A. Vaseen, 9840 W. 35th Ave., Wheat Ridge, Colo. 80033; Ruel C. Terry, 3090 S. High St., Denver, Colo. 80210

[21] Appl. No.: 95,319

[22] Filed: Nov. 19, 1979

[51] Int. Cl.[3] ..... F02G 3/00; F02G 5/02; E21B 43/22; E21B 43/40

[52] U.S. Cl. ..... 166/267; 60/39.05; 60/39.55; 166/268; 210/766; 423/569

[58] Field of Search ..... 290/1, 2; 60/39.05, 60/39.55; 210/63 R; 166/266, 267, 268, 272; 423/569

[56] References Cited

U.S. PATENT DOCUMENTS

| | | | |
|---|---|---|---|
| 3,588,265 | 6/1971 | Berry | 290/2 UX |
| 3,685,581 | 8/1972 | Hess et al. | 166/272 |
| 3,854,531 | 12/1974 | Carlin | 166/272 |
| 3,908,762 | 9/1975 | Redford | 166/272 X |
| 3,913,671 | 10/1975 | Redford et al. | 166/272 X |
| 4,013,560 | 3/1977 | Pradt | 60/39.05 X |
| 4,100,730 | 7/1978 | Pradt | 60/39.05 |
| 4,160,479 | 7/1979 | Richardson et al. | 166/267 |

*Primary Examiner*—Stephen J. Novosad
*Attorney, Agent, or Firm*—Ruel C. Terry

[57] ABSTRACT

Heavy oil from underground oil sands or tar sands is liquified with recirculation of superheated water and when brought to the ground surface is then wet oxidized for its heat value. The sulphur content of the products of wet oxidation is then wet reduced to elemental sulphur for by-product. The carbon dioxide gas generated as a product of wet oxidation is injected back to wells for its value as a diluter of the oil. Heat produced from wet oxidation is used for useful work at wells site.

6 Claims, 3 Drawing Figures

PRODUCTION AND WET OXIDATION OF HEAVY CRUDE OIL FOR GENERATION OF POWER

FIELD OF THE INVENTION

This invention relates to the production of heavy crude oil and its conversion to heat energy. More particularly the invention discloses a combination of producing heavy crude oil by reducing its viscosity by adding heat and further thinning the heated crude with carbon dioxide, then wet oxidizing the crude oil for its heat content, followed by reducing the generated sulphur dioxide to elemental sulphur.

HISTORICAL AND DESCRIPTION OF PRIOR ART

The recovery of petroleum from tar sands and heavy oil sands in which one or more injection passages and two or more removal passages are established between the surface of the ground and an underground petroleum deposit is a process patent now of record, U.S. Pat. No. 4,019,578 of Terry et al. Hot water is injected into the petroleum deposit at a temperature above the pour point temperature of the petroleum substance, and heat is transferred until the petroleum substance losses sufficient viscosity to become fluid and flowable. Under the influence of induced pressure, the petroleum substance is made to flow countercurrent to the flow of heat, where it flows up an ejection passage for collection at the surface of the ground.

Wet oxidation is a term applied to the chemical reaction of oxidation which takes place in a fluid retained as a liquid under elevated temperature and super-atmospheric pressure. Original process disclosures were processed in an aqueous media. More recently disclosures of the present inventors in co-pending application for patents, Ser. Nos. 832,635 filed Sept. 12, 1977 and 881,012 filed Feb. 24, 1978, teach processes in which both greater temperatures and greater super-atmospheric pressures are used along with an inert non-aqueous carrier liquid for absorbed gases. These greatly reduce time required for wet reactions to proceed, as well as to promote greater efficiency. The wet reaction is now disclosed herein for chemical reduction reactions as well as for wet oxidation.

The combination of these several processes is now taught which eliminates the requirement for refining the tar or heavy oil prior to combustion use; provides for recovering the heat with which it was fluidized, creating power from the maximum BTU availability and having less products of combustion which require disposal to the atmosphere. Also with high sulphur petroleum crudes elemental sulphur is produced as a by-product.

REFERENCES

U.S. Pat. Nos.:
4,019,578—Apr. '77 Terry, et al
4,022,280—May '77 Stoddard, et al
4,058,164—Nov. '77 Stoddard, et al

SUMMARY

The major undeveloped deposits of petroleum substances in the world are in the shale and tar sand formations. Processes are now developing which make it feasible both technologically as well as economically to bring the tar and heavy oil substances to the ground surface. Many of the tar and heavy oil petroleum deposits contain large quantities of sulphur and other undesirable substances. Refining of these tars and heavy oils is not only consumptive of much of their heat value (often in excess of 50%) but also by the costly necessity to reduce their product sulphur content.

This invention eliminates the need of refining the raw tar or heavy oil as well as takes advantage of the heat value of the oxidizing sulphur and its compounds, with sulphur as a by-product of the total process.

The invention starts with the production of tar or heavy oil, hereafter called "heavy oil", generally of API gravity 20 or heavier. The heavy oil as recovered from the ground is hot, at or near the same temperature as the circulating hot water, for example 200° F. or higher.

The hot, heavy oil, is transferred to the wet oxidation vessel; and the hot water, recovered and separated from the heavy oil, is recycled to the injection passages or wells.

The wet oxidation is preferably accomplished in a vessel in which a process temperature is attained compatible with the superatmospheric pressure desired. The hot heavy oil is preferably injected direct from the ground into the wet oxidation vessel through an injector device, such as a venturi, into which is mixed the oxygen required for chemical oxidation together with the inert carrier liquid. The heat produced in the wet oxidation vessel, as accumulated and contained in the inert carrier liquid, is removed at a heat exchanger between the wet oxidation reaction vessel liquid effluent nozzles and the injection device, the inert carrier liquid being recycled through the wet oxidation reaction vessel.

A small portion of this captured heat is used to reheat water in support of continuing heavy oil production. A larger portion of the available heat is used to raise steam, which in turn is used on site to generate electricity.

The wet oxidation vessel in its simplest form has the injection device at the bottom of preferably a vertical cylindrical shaped vessel. Following the injection of the hot heavy oil, stoichiometric oxygen quantity and hot carrier liquid, the mixture rises hydraulically up through the vessel for the duration of time required to wet oxidize the heavy oil to its gaseous products of sulphur dioxide, carbon dioxide, nitrous oxides, and water. The pressure is retained above the "flash" temperature of the water formed which permits it to be captured as water at the top of the vessel.

Along the vertical height of the vessel are withdrawal nozzles and valves permitting the withdrawal of the hot inert carrier liquid, at various levels throughout the vessel. Recirculation of the withdrawn hot inert carrier liquid through a heat exchanger, then back through the wet oxidation vessel is the means by which the operating temperature of the vessel contents is controlled.

The major heat produced is the exothermic chemical oxidation reactions heat, the greater quantity being produced at the bottom of the vessel. Removal of the vessel contents, at various side wall elevations, through a heat exchanger, not only captures this heat for useful work, but controls the vessel operating temperature throughout its height (or length if horizontal configuration).

The pressure of the vessel contents is superatmospheric, which along with the temperature of operation is sufficient to retain the water produced from chemical reactions as liquid. The water having a specific gravity of 1.00 as compared to the inert carrier liquid with a specific gravity greater than 1.00 floats atop the inert carrier liquid from whence it is withdrawn through a heat exchange/cooler. Withdrawn water at the desired temperature is then recycled to the geological heavy oil formations underground. The heavy oil particles along with "light fractions" produced in the wet oxidizer vessel both have a specific gravity of less than 1.00, and thus float on the water phase at the top of the reactor. They are removed, preferably, to the wet reducer/oxidation vessel as the fuel or provider of the reducing agent, carbon monoxide. Sulphur dioxide is reduced to elemental sulphur while simultaneously the carbon monoxide is oxidized to carbon dioxide.

The hot gases of sulphur dioxide, carbon dioxide, and nitrous oxides; produced in the wet oxidation reactor rise to the apex of reactor vessel where they are withdrawn and are directed to the wet reduction oxidation vessel for recovery of the sulphur.

The wet reduction oxidation reaction vessel, sometimes called a redox vessel, is designed to have an upflow velocity of its contents at a velocity which permits the ash and elemental sulphur produced therein to settle to the vessel bottom and there be removed. The sulphur when removed, preferably at 480° F. is a liquid which when withdrawn from the bottom of the reactor vessel is then separated from the inert carrier liquid and is ready for refining or direct use. Preferably the hot liquid as withdrawn from the redox vessel is cooled to facilitate the separation of the sulphur from the inert carrier liquid, as well as recover the heat for useful work. Sulphur cooled below 240° F. will solidify to facilitate separation.

The wet redox vessel is provided a fraction of the hot inert carrier liquid from the wet reactor system along with its entrained unconsumed heavy oil (which may be supplemented with additional heavy oil as a fuel) to provide the desired carbon monoxide reducing material. The hot inert carrier liquid, hot heavy oil and the product of oxidation gases as removed from the wet oxidizer are preferably premixed in an injector, such as venturi, and distributed throughout the total area of the wet redox vessel at a point near the bottom but above the sulphur collection sump in the vessel. Heavy oil and light fractions which are not chemically reacted rise to the top of the vessel (with vertical configuration) from whence they are withdrawn and recycled through the redox reactor; or removed from the system for separate refining or use.

The top of the vessel is preferably operated at a temperature above the flash point of water to steam, removing any water, as steam, along with the gases. The hot gases collected at the top of the redox reactor are withdrawn and are injected along with the hot water into injection passages underground for continuing heavy oil production.

The spent inert carrier liquid is removed, preferably through a temperature control heater/cooler then recycled back to the wet oxidizer vessel.

DESCRIPTION OF THE PREFERRED EMBODIMENT

Figure 1:
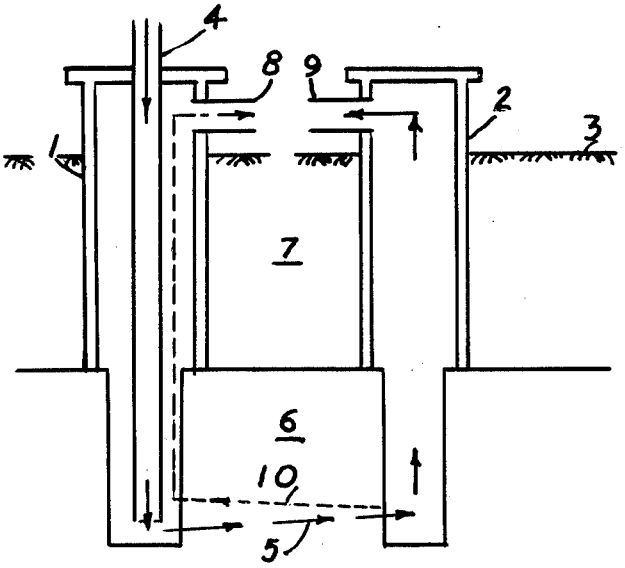
FIG. 1 is a vertical section in diagrammatical form taken through a portion of the earth showing arrangement of apparatus for the methods of the invention.
Figure 2:
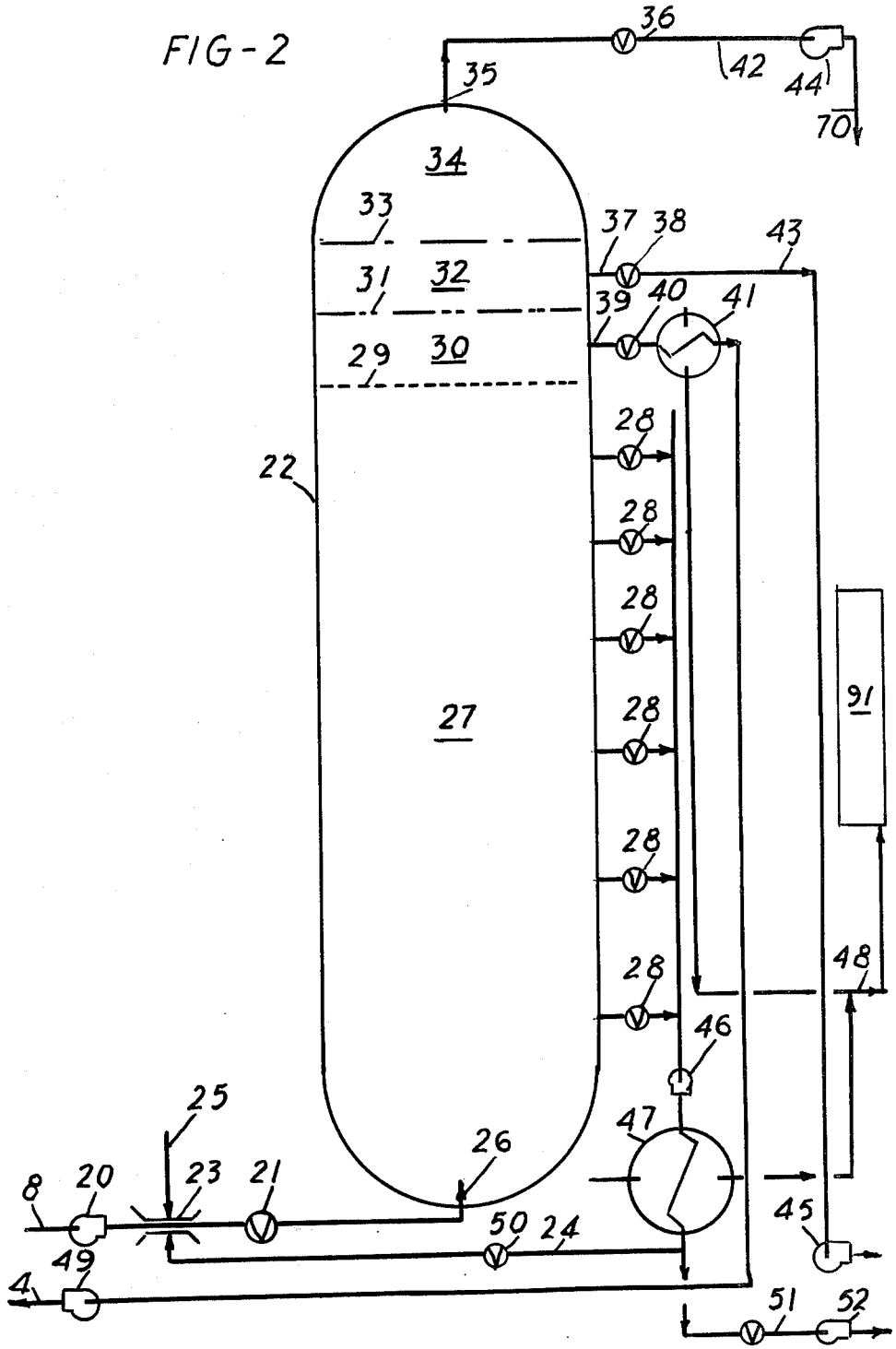
FIG. 2 is diagrammatical sketch showing arrangement of apparatus for the wet oxidation reactor of the invention.
Figure 3:
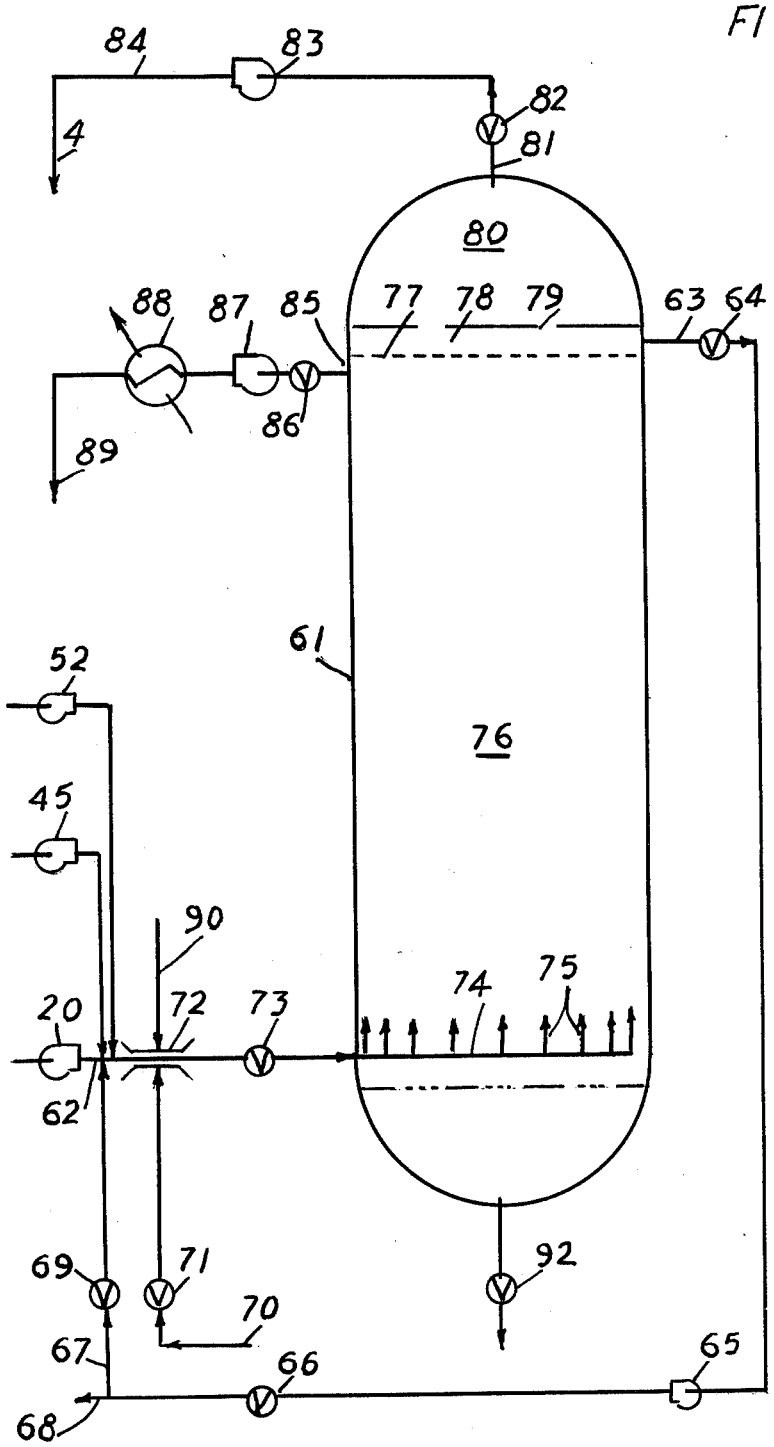
FIG. 3 is a diagrammatical sketch showing arrangement of apparatus for the wet redox reactor of the invention.

The production of heat for useful work by wet oxidation of heavy oils or tars at or near the site of the heavy oil production along with the elimination of a refinery is a considerably more efficient method of generation of power or other useful work than the process sequences of production, transportation, refining, transportation, combustion, and power generation.

Wet oxidation to be time effective must be carried out under conditions of superatmospheric pressure and elevated temperature.

Product heavy oil or tar is preferably produced from the underground reservoir by liquification with hot water. The sensible heat retained in the hot petroleum facilitates the next step, wet oxidizing the petroleum to residue.

The art and science of hot water heavy oil production, wet oxidation and sulphur recovery by wet reduction is best sought by way of example.

The example described is based on a modular concept, each unit of production added together to integrate into a facility complex meeting the design requirements for total heavy oil or power sought.

For a single module example, heavy oil (9) is recovered from a pair of wells (1) (2) or passageways at a rate of 218.89 pounds per minute with a temperature of 150° F. with a sensible heat of 15,591 BTU per minute. Water injected in the production well (1) is injected at the rate, for example of 220 pounds per minute at 300° F. with a sensible heat of 69,630 BTU per minute. The hot water is recovered at the return well (2) at 150° F. with a sensible heat content of 20,369 BTU per minute.

The 218.89 pounds of heavy oil (8) at a temperature of 150° F. with a sensible heat content of 15,591 BTU per minute is, preferably, immediately injected at a superatmospheric pressure compatible with the inert carrier liquid selected for use with the wet oxidation process; for example (40) forty atmospheres.

DESCRIPTION OF THE PREFERRED EMBODIMENT

The pressure and flow rate, for example, 218.89 pounds per minute, is accomplished by a pump (20), which discharges through a mixing device, such as a venturi (23). The mixing device homogeneously mixes a return flow of the inert carrier liquid (24); for instance at a rate of 289.90 pounds per minute with the heavy oil and at the same time adds not less than stoichiometric oxygen, preferably pure oxygen or oxygen concentrated air, at, for example, 632.95 pounds of oxygen per minute. Air is permissible as the oxygen providing medium, but oxygen is preferable.

The inert carrier liquid is selected from, preferably, the family of fully halogenated hydrocarbons which will sustain a recycle extended use at the operating temperatures selected in concert with the superatmospheric pressures selected; for example a $C_{10}F_8$ fluorocarbon and 480° F. with 40 atmosphere. Preferably, the compound should have eight (8) or more carbon atoms and preferably be a perfluorocarbon. The inert carrier liquid compound should be non-volatile, non miscible with water and non toxic.

Those familiar with inert carrier liquids, that is, a liquid having an affinity for absorbing gases, and thus a carrier of gases; will have no difficulty selecting from the many hundreds of fully halogenated hydrocarbons available from the commercial vendors and manufacturers of these compounds.

The reactor vessel (22) can be horizontal, vertical and of various configurations, but preferably is vertical with an upflow reaction zone (27). The velocity of the upflow is designed to carry suspended material, for example product of wet oxidation ash of 1.32 pounds per minute, and eventually remove it from the vessel along with the effluent materials. The interior of the vessel is baffled or otherwise designed to sustain turbulence of flow. (not shown).

The inert carrier liquid, filled to contact level interface (29) between the reaction zone (27) and water zone (30), is preferably preheated to 480° F. and pressurized to 40 atmospheres, prior to first operation. This is most easily accomplished by steam injection at the mixer (23) by way of the oxygen influent (25) along with the inert carrier liquid as it is being injected into the vessel (26). The steam condensate rises to fill the water zone (30) between the oil/water contact (31) and the reaction zone/water contact (29).

The reaction time is determined for the conditions of operation; for example 480° F. and 40 atmospheres would have a reaction time of approximately two minutes. The time of reaction determines the area and height of the wet oxidation reaction vessel: for example a diameter of (20") twenty inches and a vertical shell reaction zone (27) of (40') forty feet.

A constant flow of heavy oil into the wet oxidation reactor in the amount of 218.89 pounds per minute will produce a total sensible heat of $4.167\times10^6$ BTU per minute. Temperature rise of the vessel contents control is accomplished, preferably by a series of withdrawl nozzles and pressure/flow control valves (28) along the direction of flow of the vessel contents, removing liquid contents at 481° F. or above for recycle through the heat recovery heat exchanger (47) by means of a recirculation pump (46).

The heat recovered, allowing for radiation and convection losses in the system as well as heat required for the production wells hot water, is for example $3.467\times10^6$ BTU per minute, yielding a calculated efficiency of heat recovery out of the heavy oil of 88.79%. This heat is used to raise steam which, in turn, is expanded through a turbine which drives a generator (91). Thus the heat available from a single module would support the generation of electricity in a 50 megawatt plant.

Heavy oil which is not wet oxidized the first, or on repeated cycles through the wet reactor, is floated (32) on the water zone (30) at contact surface (31) and withdrawn as necessary by recycle and transfer pump (45) by means of control of pressure and flow control valve (38) at effluent nozzle (37) and transmission line (43)

Wet oxidation of the heavy oil produces a quantity of water, for example 114.50 pounds per minute at 480° F. The pressure and temperature combination is preferably such that the water is retained as water (30) which floats above (29) the reaction zone contents (27) and upon (31) which floats the oil produced (32). Withdrawal of the water eliminates it from being processed with the product gases in the wet reducer/oxidizer.

The hot water is drawn off through nozzle (39) by control of pressure/flow control valve (40) through a heat exchanger (41) wherein the temperature is lowered to the injection (4) temperature used at injection well (1). The heat captured therein used to supplement the total heat output (48) of the total system for power generation or useful work.

The hot dry gases produced as products of wet oxidation rise through the reactor and are collected above the contact surface (33) between the oil (32) and the gas (34). The gaseous products, for example a composite of 21.50 pounds per minute of sulphur dioxide, 5.96 pounds per minute of nitrous oxides, and 709.90 pounds per minute of carbon dioxide; are relieved through nozzle (35) by control valve (36) through transmission line (42) and if required repressurized by pump (44) which discharges the hot gases; preferably at 480° F. to the wet redox vessel (61).

Most heavy oils and tar deposits contain a high sulphur content. The sulphur produces products of combustion which either make it unsuitable as a combustible or greatly reduce its value due to the energy and cost of removing it. The reduction of the sulphur dioxide (or other oxides that may exist) to sulphur is accomplished in the wet redox vessel (61).

Partial combustion of heavy oil or light petroleum fractions as recovered from the wet oxidizer is accomplished, preferably in a separate CO production burner, for providing a predominance of carbon monoxide (90) to sulphur dioxide in the redox vessel. Preferably, said ratio being greater than 3 to 1 CO to $SO_2$. Stoichiometric conversion of 8.89 pounds of heavy oil per minute is required to produce the carbon monoxide required for reducing the sulphur dioxide to elemental sulphur. Some petroleum substances will be produced from particulate heavy oil carryover from the wet oxidizer, as well as from supplemental fuel to the Redox vessel. This material floats above the reaction zone (76) producing contact surface (77). This material is returned for use in the wet reactor via effluent nozzle (63) and control valve (64) and is recycled by pump (65) which returns it to the wet reducer (Redox Vessel) mixer (72) via control valves (66) (69); or returns it (68) to the wet oxidizer or storage or other use, such as carbon monoxide production (not shown).

The homogeneous mixture of hot inert carrier liquid, for example 735.35 pounds per minute, 8.89 pounds per minute of petroleum substances; and 737.36 pounds per minute of hot gases is injected at a controlled pressure and temperature through control valve (73) into a manifold (74) system near the bottom end of the, preferably, vertical, wet redox vessel, where the materials are uniformly as a mixture jeted up by nozzles (75) through the reaction zone (76) of the vessel.

The vessel can be horizontal, vertical; and of any configuration, but preferably is vertical with an area to length which controls the velocity to that which permits the reduced elemental sulphur to settle to the bottom countercurrent to the vessel contents flow. Interior baffles are used to produce continued turbulence in the vessel (not shown).

The reduction of the sulphur dioxide is endothermic and the partial oxidation of the petroleum substances is exothermic. For example the net BTU balance is an input heat or supplemental heat of 3859 BTU per minute. This is provided by control of the extra quantity of "fuel" injected along with the heat transferred (62) from the wet oxidation reaction system in the hot carrier liquid.

Preferably the system is operated at a temperature/-pressure combination which will flash any trace water formed or carried in the system to steam and dispose of it with the carbon dioxide gas, for example, 728.8 pounds per minute, which is removed from the gas collection dome (80) which lies above the gas/oil contact surface (79). The hot carbon dioxide is relieved through nozzle (81) by means of control valve (82) and by means of pump (83) and transmission main (84) is returned and reinjected into the production well (1) along with the hot water (4) where the carbon dioxide acts as an additional heavy oil diluter when operated so as to produce water, it is removed through heat exchanger (41) and the water cooled to for example 200° F. is returned to heavy oil production (4) hot spent, carrier liquid is removed from the top of the wet reduction vessel via nozzle (85) and control valve (86) and transferred by pump (87) through heat/cool, temperature adjuster back to the wet oxidation system for recycle.

Preferably the wet redox vessel increases in temperature from bottom at 480° F. to top at 600° F. when the operating temperature is 40 atmospheres; or at some temperature above the flash temperature of water to steam.

The elemental sulphur produced in the wet reducer vessel settles to the bottom of the reactor where it is pooled as "liquid" sulphur below the influent liquids manifold. The sulphur is withdrawn through a withdrawal nozzle and control valve, preferably 10.75 pounds per minute as a slurry with 204.25 pounds of inert carrier liquid. The ash, for example, 1.32 pounds per minute will be carried out along with the hot sulphur. The sulphur can optionally be removed by itself and prilled or otherwise recovered (92).

Preferably the sulphur and inert carrier liquid are heat exchanger cooled, with the recovered heat supplementing the wet oxidizer output; or used to balance the deficit heat requirement of the wet redox vessel.

Thus is taught the art and science of wet oxidation/wet reduction of heavy oil for efficient capture of exothermic heat of chemical reactions together with total use of heavy oil product for useful work. Products of oxidation, normally vented to the atmosphere are used for enhanced oil production. Also is taught a method in which, simple low cost equipment items, not only process the heavy oils direct, but enhance the production of same by producing a carbon dioxide reinjection gas usable as a petroleum diluter.

The teaching of the art and science of use of heavy oils containing high sulphur content for direct conversion to power and useful heat energy has been by way of example. It is understood that quantities, pressure, temperatures, rates, etc; along with vessel configurations and piping arrangements and controls; has been by way of explanation and process alterations, and apparatus configurations can be made without altering the spirit thereof.

What it claimed is:

1. A method of generating electricity wherein a source of heavy crude oil is connected to a wet oxidation reactor that converts the chemical energy of the heavy crude oil into heat, which, by indirect heat exchange, is used to raise steam that, in turn, drives a turbine connected to an electric generator, comprising the steps of establishing a source of crude oil, injecting the heavy crude oil together with an inert oxygen carrying liquid into a wet oxidation reactor, wet oxidizing the heavy crude oil into carbon dioxide, water, sulphur dioxide and ash residue, capturing the heat of wet oxidation reactions, capturing the carbon dioxide, water and sulphur dioxide, transferring the said heat of wet oxidation reactions to water with the resultant conversion of the said water to steam, expanding the said steam through a turbine connected to an electric generator with the resultant generation of electricity, separating the sulphur dioxide from the said captured carbon dioxide, water and sulphur dioxide, establishing a source of carbon monoxide, injecting the said separated sulphur dioxide into a redox vessel, reducing the said sulphur dioxide to elemental sulphur and oxygen, then oxidizing the said carbon monoxide to carbon dioxide.

2. The method of claim 1 further including the step of withdrawing the elemental sulphur as a liquid from the said redox vessel.

3. The method of claim 1 further including the step of withdrawing the carbon dioxide from the said redox vessel.

4. The method of claim 3 wherein the said source of crude oil is heavy oil from underground oil sands and further including the step of injecting the said carbon dioxide withdrawn from the said redox vessel into the said underground oil sands.

5. The method of claim 1 wherein the said source of crude oil is heavy oil from underground oil sands and further including the step of injecting the said captured water into the said underground oil sands.

6. The method of claim 1 wherein the said source of crude oil is heavy oil from underground oil sands and further including the step of injecting the said captured carbon dioxide into the said underground oil sands.

* * * * *